US006651810B2

(12) United States Patent
Nichol, Jr.

(10) Patent No.: US 6,651,810 B2
(45) Date of Patent: Nov. 25, 2003

(54) HOSIERY DISPLAYING DEVICE WITH ARRAYED MULTIPLICITY OF HOSIERY ATTACHMENT OPENINGS

(75) Inventor: William H. Nichol, Jr., Hopkinsville, KY (US)

(73) Assignee: Kentucky Derby Hosiery Co., Inc., Hopkinsville, KY (US)

( * ) Notice: Subject to any disclaimer, the term of this patent is extended or adjusted under 35 U.S.C. 154(b) by 0 days.

(21) Appl. No.: 09/820,595

(22) Filed: Mar. 29, 2001

(65) Prior Publication Data

US 2002/0139697 A1 Oct. 3, 2002

(51) Int. Cl.[7] ..... B65D 85/18
(52) U.S. Cl. ..... 206/297; 211/113; 206/278
(58) Field of Search ..... 211/85.3, 113, 211/1; 223/85; 206/278, 292, 293, 294, 296, 297, 299

(56) References Cited

U.S. PATENT DOCUMENTS

| | | | | |
|---|---|---|---|---|
| 1,755,605 A | | 4/1930 | Knox | |
| D132,286 S | * | 5/1942 | Soukup et al. | D6/315 |
| 2,523,682 A | | 9/1950 | Corwin | |
| 2,709,006 A | | 5/1955 | Ludwig | |
| 2,755,013 A | | 7/1956 | Beede | |
| 2,788,121 A | | 4/1957 | Ayres | |
| 2,857,085 A | | 10/1958 | Bowman et al. | |
| 3,037,621 A | | 6/1962 | Jackman | |
| 3,081,881 A | * | 3/1963 | Seeger | 211/113 |
| 3,378,180 A | | 4/1968 | Singer | |
| 3,458,093 A | | 7/1969 | Bacharach | |
| 3,462,068 A | | 8/1969 | Suominen | |
| 3,469,679 A | | 9/1969 | Kamins et al. | |
| 3,486,683 A | | 12/1969 | Kamins | |
| 3,498,446 A | | 3/1970 | Lafreniere | |
| 3,542,170 A | | 11/1970 | Bialo | |
| 3,592,343 A | * | 7/1971 | Swett | 211/113 X |
| 3,692,269 A | | 9/1972 | Hales | |
| 3,783,995 A | | 1/1974 | Tobin | |
| 3,809,194 A | | 5/1974 | Chappelle et al. | |
| 3,900,181 A | | 8/1975 | Pitanis | |
| 3,945,500 A | * | 3/1976 | Meckstroth | 211/113 X |
| 3,997,091 A | | 12/1976 | Burnette | |
| 3,999,656 A | | 12/1976 | Hydorn | |
| 4,132,309 A | | 1/1979 | Shaylor | |
| 4,189,049 A | | 2/1980 | Silver | |
| 4,219,140 A | | 8/1980 | Simonoff | |
| 4,266,677 A | | 5/1981 | Dewsnap | |
| 4,346,825 A | | 8/1982 | Leger | |
| 4,593,812 A | | 6/1986 | Dillingham | |
| 4,601,417 A | | 7/1986 | Kunreuther | |
| 4,718,546 A | | 1/1988 | Kolton et al. | |
| 4,742,914 A | | 5/1988 | Klein | |
| 4,759,440 A | | 7/1988 | Kolton et al. | |
| 4,765,467 A | | 8/1988 | Kolton et al. | |
| 4,768,649 A | | 9/1988 | Kolton et al. | |
| 4,805,816 A | | 2/1989 | Freund | |
| 4,944,417 A | * | 7/1990 | Datlow | 211/113 X |

(List continued on next page.)

FOREIGN PATENT DOCUMENTS

| | | |
|---|---|---|
| FR | 2261933 | 9/1975 |
| FR | 2399365 | 4/1979 |

*Primary Examiner*—Tri M. Mai
(74) *Attorney, Agent, or Firm*—Kennedy Covington Lobdell & Hickman, LLP

(57) ABSTRACT

A hosiery displaying device comprises a main body with a hosiery attachment region defined by a multiplicity of openings in a grid-like array through the main body, each opening being configured to receive therethrough a fastener for securing a hosiery article. A hook-shaped hanger portion extends from one longitudinal side of the main body for hanging the device from a retail display fixture and a U-shaped stabilizing portion extends from the opposite longitudinal side of the main body for supporting engagement with hosiery articles secured thereto.

13 Claims, 1 Drawing Sheet

U.S. PATENT DOCUMENTS

| | | | | | |
|---|---|---|---|---|---|
| D311,458 | S | * | 10/1990 | La Croix | D6/315 |
| 4,966,287 | A | * | 10/1990 | Snyder | 211/85.3 |
| 5,014,957 | A | | 5/1991 | Nichol, Jr. | |
| 5,040,686 | A | | 8/1991 | Morrow | |
| D323,755 | S | * | 2/1992 | Harney | D6/513 |
| 5,261,529 | A | | 11/1993 | Holland | |
| 5,363,953 | A | | 11/1994 | Carter | |
| 5,390,800 | A | | 2/1995 | Tucker | |
| 5,427,230 | A | | 6/1995 | Mattox | |
| D371,070 | S | * | 6/1996 | Brier | D9/415 |
| 5,950,815 | A | | 9/1999 | Yetman-Bellows | |
| 6,094,848 | A | * | 8/2000 | Heath et al. | 40/322 |

* cited by examiner

HOSIERY DISPLAYING DEVICE WITH ARRAYED MULTIPLICITY OF HOSIERY ATTACHMENT OPENINGS

BACKGROUND OF THE INVENTION

The present invention relates generally to hosiery displaying devices and, more particularly, to such devices adapted for hanging display of a plurality of hosiery articles, e.g., from a conventional retail display fixture.

One preferred means of displaying hosiery articles, e.g., pairs of socks in retail establishments is to suspend the socks from a display fixture using a hanger device which leaves all or a substantial portion of the hosiery article exposed. This method permits the potential purchaser to touch and examine the hosiery articles as well as offering the potential purchaser an immediate visual basis of comparison between various hosiery articles on display so that the purchaser may readily determine the appropriate color, fabric and construction of the hosiery article desired to be purchased.

A number of hanger devices have been proposed for displaying hosiery articles in this fashion. One conventional hanger device is a single plastic hook having a hole at the lower end of the hook for receiving a plastic fastener inserted through a folded pair of hosiery to be suspended. While this form of hanger device achieves the aforementioned advantage of leaving the hosiery article substantially exposed for customer inspection, the hanger device is capable essentially only of displaying a single pair of hosiery, whereas in contrast retailers prefer to package hosiery in multiple pairs as a means of increasing sales volume and revenues.

Accordingly, another conventional type of hosiery display device in common use in retail establishments comprises a clear plastic bag in which pairs of hosiery articles are contained and suspended by a one-piece plastic display hanger which supports an upper margin of the plastic bag. While this form of display device satisfies the retail objective of packaging multiple hosiery pairs, the use of a plastic bag prevents the customer from being able to touch and feel the hosiery articles prior to purchase.

A popular form of improved hosiery displaying device which overcomes the disadvantages of these earlier devices is disclosed in U.S. Pat. No. 5,014,957. This patent discloses a hanger assembly capable of supporting multiple pairs of hosiery articles in suspended disposition from a conventional sock retailing display fixture. The hanger assembly basically includes an elongate main body portion and a longitudinally centered hook-shaped fixture attachment portion integrally formed from plastic. The main body includes a plurality of sock attachment openings spaced along the longitudinal extent in balanced relation to the hanging axis HA of the main body whereby a corresponding plurality of hosiery pairs may be attached to the main body at the attachment locations via a plurality of plastic fasteners.

While the hanger assembly of this patent has met with significant commercial success, one disadvantage is that care must be taken to align the pre-formed openings in the device with the gun utilized to shoot fasteners through the hosiery and then through the hanger device in order to insure that the fasteners pass through the pre-formed openings. Also, the pre-formed openings may need to be located differently to accommodate different sizes and types of hosiery articles.

SUMMARY OF THE INVENTION

It is accordingly an object of the present invention to provide an improved hosiery displaying device which incorporates all of the advantages and features of the device of U.S. Pat. No. 5,014,957, while improving the ease of use thereof and otherwise providing additional advantageous features.

The present invention achieves this objective by providing a hosiery displaying device basically comprising a main body having a hosiery attachment region defined by a multiplicity of openings formed through the main body in an array extending in both a longitudinal extent and a transverse extent of the main body, with each opening being of a configuration adapted for extension therethrough of a fastener element for securing an article of hosiery to the main body. In this manner, the arrayed multiplicity of openings simplifies and speeds the process of attaching hosiery articles to the device by eliminating the need to precisely align any individual opening with a fastener attachment gun or other device. The multiplicity of openings additionally enables the device to accommodate hosiery articles of different sizes and types without specially providing for different placement of the fastener openings.

In a preferred embodiment of the present hosiery displaying device, the arrayed multiplicity of openings are arranged in the form of a grid wherein the openings are generally uniformly spaced relative to one another, e.g., in longitudinal rows and traverse columns, by a distance less than the size of an individual one of the openings. Preferably, the main body of the hosiery displaying device is generally planar and of a regular geometric shape with the array of openings disposed generally symmetrically of the longitudinal extent of the main body. For example, it is particularly preferred that the main body be generally rectangular and the array of openings be correspondingly rectangular and centered symmetrically with respect to the main body.

According to another feature of the present invention, the hosiery displaying device further comprises a hanger portion extending from the main body generally centrally with respect to the longitudinal extent thereof. For example, the hanger portion may preferably comprise a hook-shaped projection from the main body, defining an entrance slot extending angularly away from the main body for receiving a hanging support, e.g., a retail display rod, for suspension of the main body therefrom. The hook-shaped projection preferably comprises a flexible hook portion yieldable to open the entrance slot, thereby to accommodate placement of the device onto and removal from a retail display rod or other hanging support.

Another feature of the present invention provides a stabilizing portion extending from the main body opposite the hanger portion for supporting engagement with an article of hosiery when secured to and suspended from the main body. Preferably, the stabilizing portion is generally U-shaped with respect to the main body.

DETAILED DESCRIPTION OF THE PREFERRED EMBODIMENT

Figure 1:
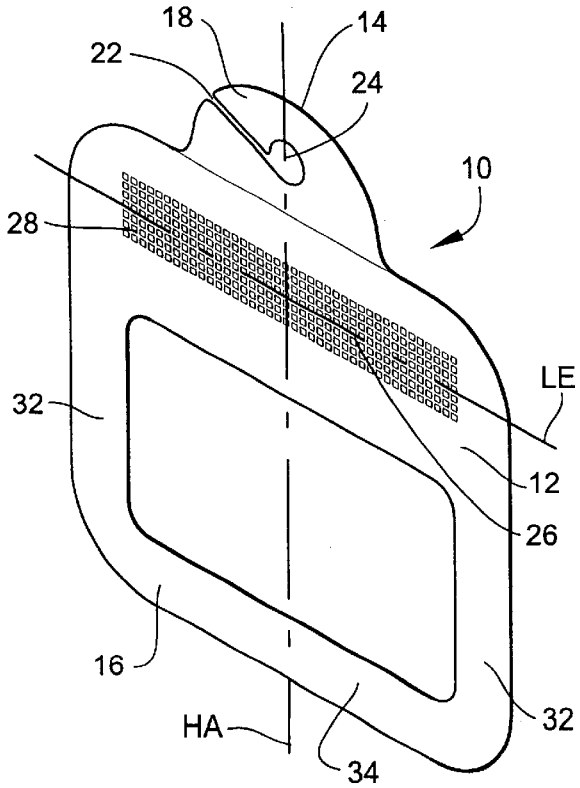
FIG. 1 is a perspective view of a hosiery displaying device in accordance with a preferred embodiment of the present invention.

Referring now to the accompanying drawings, a preferred embodiment of the hosiery displaying device of the present invention is illustrated and generally designated at 10. As best seen in FIG. 1, the displaying device 10 basically comprises a main body 12 having an elongate longitudinal extent LE and a central hanging axis HA perpendicular to the longitudinal extent LE, a hanger portion 14 projecting from one side of the main body 12 centrally with respect to the longitudinal extent LE and in alignment with the hanging axis HA and a stabilizing portion 16 extending from the opposite side of the main body 12. Advantageously, the main body 12, the hanger portion 14 and the stabilizing portion 16 may be conveniently formed integrally with one another from a planar sheet of plastic such as by a conventionally stamping, molding or other suitable forming process.

The hanger portion 14 is configured in the form of a hook 18 to engage and hang from a retail hosiery display rod 20 (FIGS. 2 and 3) or other conventional retail display fixture. The hook 18 preferably defines a relatively narrow entrance slot 22 opening into a circular rod receiving area 24 sized and configured in conformity to the retail display rod 20, with the slot 22 extending from the rod receiving area 24 upwardly and angularly away from the main body 12. The transverse dimension of the slot 22 is preferably about the same as or may even be slightly smaller than the cross sectional display rod 20. Preferably, the outwardly projecting free end of the hook 18 is sufficiently flexible to yield to open the slot 22 for easy placement of the hanger portion 14 onto and removal from the display rod 20 or other support fixture.

The main body 12 is preferably of a rectangular configuration, although various other forms of regular geometric shapes may also be utilized. In accordance with the present invention, a multiplicity of hosiery attachment openings 26 are formed through the main body 12 in an array generally uniformly spaced relative to one another, e.g., by a distance less than the size of an individual one of the openings, in longitudinal rows and traverse columns as shown in FIG. 1, collectively forming a grid 28 of substantially the same rectangular (or other geometric shape) as the main body 12 and disposed symmetrically with respect thereto. As more fully explained below, each of the openings is sized and otherwise configured to be adapted for receiving a conventional fastener element (e.g., fastener 30 as shown in FIG. 2) extended through the opening to secure an article of hosiery to the main body 12 and thereby to be suspended in the hanging relationship therefrom.

The stabilizing portion 16 basically comprises a pair of legs 32 projecting downwardly from the opposite ends of the main body 12 at the side thereof opposite the hanger portion 14 and a connecting web 34 laterally extending between and bridging the lower ends of the legs 32, thereby forming the stabilizing portion 16 overall in a generally U-shape.

Figure 2:
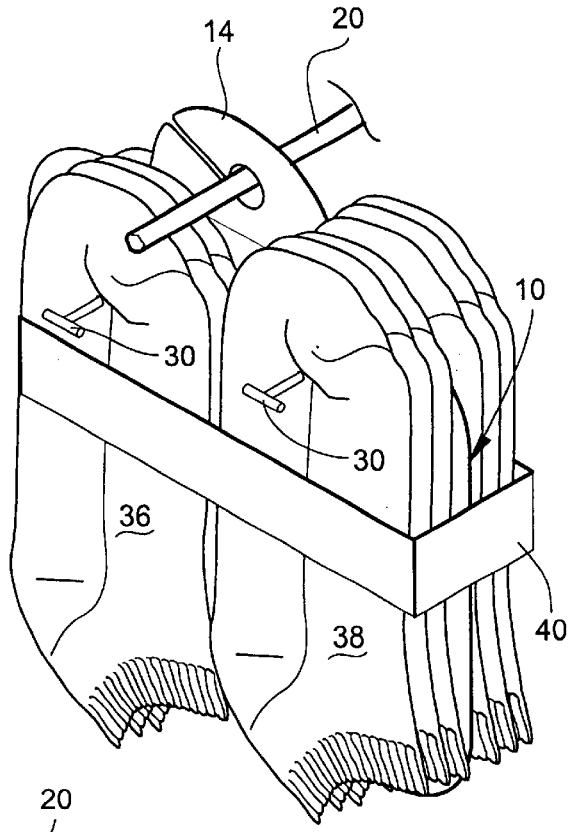
FIG. 2 is a perspective view of the hosiery displaying device of FIG. 1 in assembly with a plurality of pairs of socks for suspending the socks in a display from a conventional retail display fixture.

As will thus be understood, the hosiery displaying device 10 is adapted to support multiple pairs of substantially any type of hosiery, particularly socks, as representatively designated by sock pairs 36, 38 in FIG. 2, in a balanced suspended disposition from a conventional hosiery retail display fixture. By way of example, the displaying device 10 is illustrated in FIGS. 2 and 3 as supporting six pairs of socks in two sets of three pairs each, but it will be understood that a greater or lesser number of pairs may be supported as desired.

As previously indicated, the sock pairs are attached to the main body 12 by conventional plastic fasteners 30 of the type basically comprising a thin elongated body stem 31 with laterally projecting retainer portions 33 at the opposite ends of the stem 31. As is known, such fasteners 30 may be projected through textile fabrics via a conventional installation gun. Advantageously, the multiplicity of openings 26 arrayed within the grid 28 of the main body 12 provide numerous locations for such fasteners 30 to penetrate readily through the main body 12 without the necessity of carefully aligning the fastener installation gun within any individual opening, thereby greatly simplifying and speeding the process of attaching the sock pairs 36, 38 to the device 10.

The advantageous feature of the display device of U.S. Pat. No. 5,014,957 is still achieved by facilitating the placement of the sock pairs 36, 38 equidistantly from the hanging access HA so as to cause the sock pairs 36, 38 to hang in balanced suspension from the main body 12 with its longitudinal extent LE in a generally horizontal disposition, thus orienting the sock pairs in mutually side-abutting relation to provide a pleasing aesthetic symmetry when hung from the display rod 20 or other display fixture.

Figure 3:
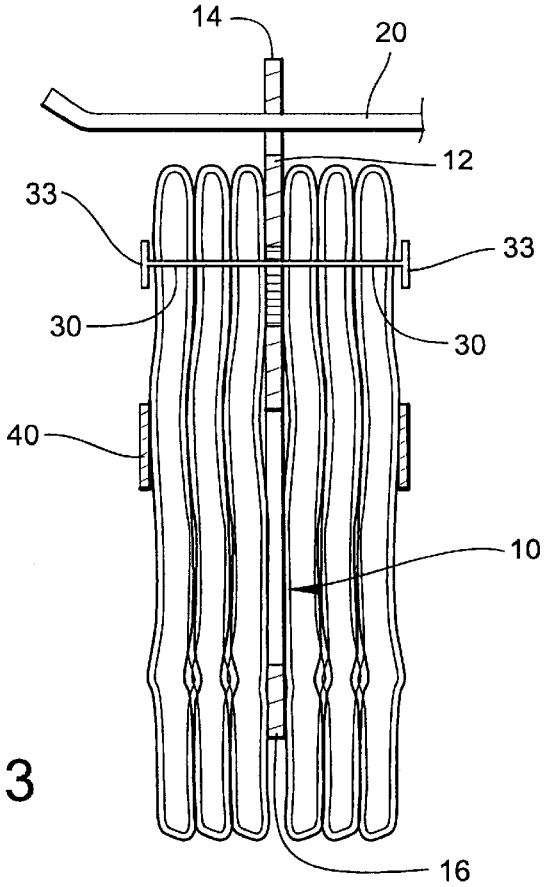
FIG. 3 is a side elevational view of the hosiery display assembly of FIG. 2, in partial vertical section taken along line 3—3 thereof.

As depicted in FIGS. 2 and 3, the sock pairs 36, 38 may be advantageously attached at both side surfaces of the main body 12 so that the device 10 is substantially covered by the sock pairs 36, 38 except for the hanger portion 14. In such an arrangement, the stabilizing portion 16 advantageously provides support for the downwardly extending suspended portions of the sock pairs 36, 38 which insures a neat and uniform overall appearance of the retail display of the hosiery. As desired, a paper band 40, e.g., of a conventional construction having an inward adhesive surface and an outward surface printed with advertising, labeling and such thereon, may be provided for encircling the suspended portions of the sock pairs 36, 38 about the stabilizing portion 16. Advantageously, the hosiery displaying device 10 resist efforts to tamper with or remove individual sock pairs supported thereby, since the sock pairs are bound together by the device 10 in combination with the fasteners 30 and the paper band 40.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In combination, at least one fastener element having an elongate body of a predefined girth and enlarged retainer portions at opposite ends of said elongate body, and a device for displaying at least one article of hosiery with the assistance of the at least one fastener element, the device comprising a main body having a hosiery attachment region defined by a multiplicity of openings formed through the main body in multiple adjacent rows, the multiple adjacent rows forming an array of the openings extending in both a longitudinal extent and a transverse extent of the main body, each opening being of a selected size and configuration in relation to the girth of the at least one fastener element to be adapted for extension therethrough of the at least one fastener element for securing an article of hosiery to the main body, the array of openings being sufficiently closely spaced in the longitudinal and transverse extents in relation to the girth of the at least one fastener element to eliminate the necessity of precisely aiming the at least one fastener element in alignment with any individual one of the openings.

2. A hosiery displaying device according to claim 1, wherein the array of the openings forms a grid wherein the openings are generally uniformly spaced relative to one another.

3. A hosiery displaying device according to claim 2, wherein the array of the openings are generally arranged in longitudinal rows and transverse columns relative to one another.

4. A hosiery displaying device according to claim 1, wherein the main body is generally planar and of a regular geometric shape with the array of the openings disposed generally symmetrically of the longitudinal extent of the main body.

5. A hosiery displaying device according to claim 4, wherein the main body is generally rectangular and the array of the openings is correspondingly rectangular and centered symmetrically with respect thereto.

6. A hosiery displaying device according to claim 1, and further comprising a hanger portion extending from the main body generally centrally with respect to the longitudinal extent thereof.

7. A hosiery displaying device according to claim 6, wherein the hanger portion comprises a hook-shaped projection from the main body.

8. A hosiery displaying device according to claim 7, wherein the hook-shaped projection defines an entrance slot extending angularly away from the main body for receiving a hanging support for suspension of the main body therefrom.

9. A hosiery displaying device according to claim 8, wherein the hook-shaped projection includes a flexible hook portion yieldable to open the entrance slot.

10. A hosiery displaying device according to claim 6, and further comprising a stabilizing portion extending from the main body opposite the hanger portion for supporting engagement with an article of hosiery when secured to and suspended from the main body.

11. A hosiery displaying device according to claim 1, and further comprising a stabilizing portion extending from the main body for supporting engagement with an article of hosiery when secured to the main body.

12. A hosiery displaying device according to claim 11, wherein the stabilizing portion is generally U-shaped with respect to the main body.

13. A device for displaying at least one article of hosiery, comprising:

a main body having a hosiery attachment region defined by a multiplicity of openings formed through the main body in multiple adjacent rows, the multiple adjacent rows forming an array of the openings extending in both a longitudinal extent and a transverse extent of the main body;

at least one article of hosiery;

at least one fastener element for securing the at least one article of hosiery to the main body through any individual one of the openings, said at least one fastener element including a plastic fastener having a thin elongate body of a predefined girth for penetrating the at least one said hosiery article without damage thereto and enlarged retainer portions at opposite ends of said elongate body;

a hanging means associated with said main body in centered relation with respect to the longitudinal extent and configured for mounting engagement with a display fixture for suspension of said main body and the at lest one hosiery article therefrom with said longitudinal extent of said main body in a generally horizontal disposition;

each opening in said hosiery attachment region being of a selected size and configuration in relation to the girth of the faster element to be adapted for extension therethrough of the at least one fastener element, the array of opening being sufficiently closely spaced in the longitudinal and traverse extents in relation to the girth of the faster element to eliminate the necessity of precisely aiming the at least one faster element in alignment with any individual one of the openings.

* * * * *